United States Patent [19]

Taylor

[11] 4,255,867

[45] Mar. 17, 1981

[54] GUIDELINE AND LAYOUT RULER FOR CALLIGRAPHERS

[76] Inventor: Ronald B. Taylor, 2828 N. Portland Blvd., Portland, Oreg. 97217

[21] Appl. No.: 967,264

[22] Filed: Dec. 7, 1978

[51] Int. Cl.[3] ..... B43L 7/08

[52] U.S. Cl. ..... 33/464

[58] Field of Search ..... 33/403, 423, 452, 464, 33/470, 477, 467, 436, 447

[56] References Cited

U.S. PATENT DOCUMENTS

| | | | |
|---|---|---|---|
| 571,252 | 11/1896 | Walkinshaw et al. | 33/436 |
| 1,969,584 | 8/1934 | Stein | 33/436 |
| 3,243,883 | 4/1966 | Morgan et al. | 33/464 |
| 3,309,775 | 3/1967 | Vieregge | 33/464 X |
| 3,635,396 | 1/1972 | Palfi | 33/464 X |

FOREIGN PATENT DOCUMENTS

| | | | |
|---|---|---|---|
| 203455 | of 1923 | United Kingdom | 33/464 |

*Primary Examiner*—Charles E. Phillips
*Attorney, Agent, or Firm*—Klarquist, Sparkman, Campbell, Leigh, Hall & Whinston

[57] ABSTRACT

A calligrapher's ruler including two fixed parallel longitudinal members each bearing a different set of graduated indicia is disclosed. A central member is slidably retained between the longitudinal members and mounts an elongated lateral straightedge member, also provided with a scale, so that the straightedge can be moved in a direction parallel to the longitudinal axes of the longitudinal members and maintained at a fixed angle, preferably perpendicular, relative thereto. A pointer on the central slide member is aligned with one of the indicia on the longitudinal members to establish the exact location of the straightedge member along the longitudinal members. A locking device on the central slide member locks the slide member and its connected straightedge in a selected position along the longitudinal members.

2 Claims, 5 Drawing Figures

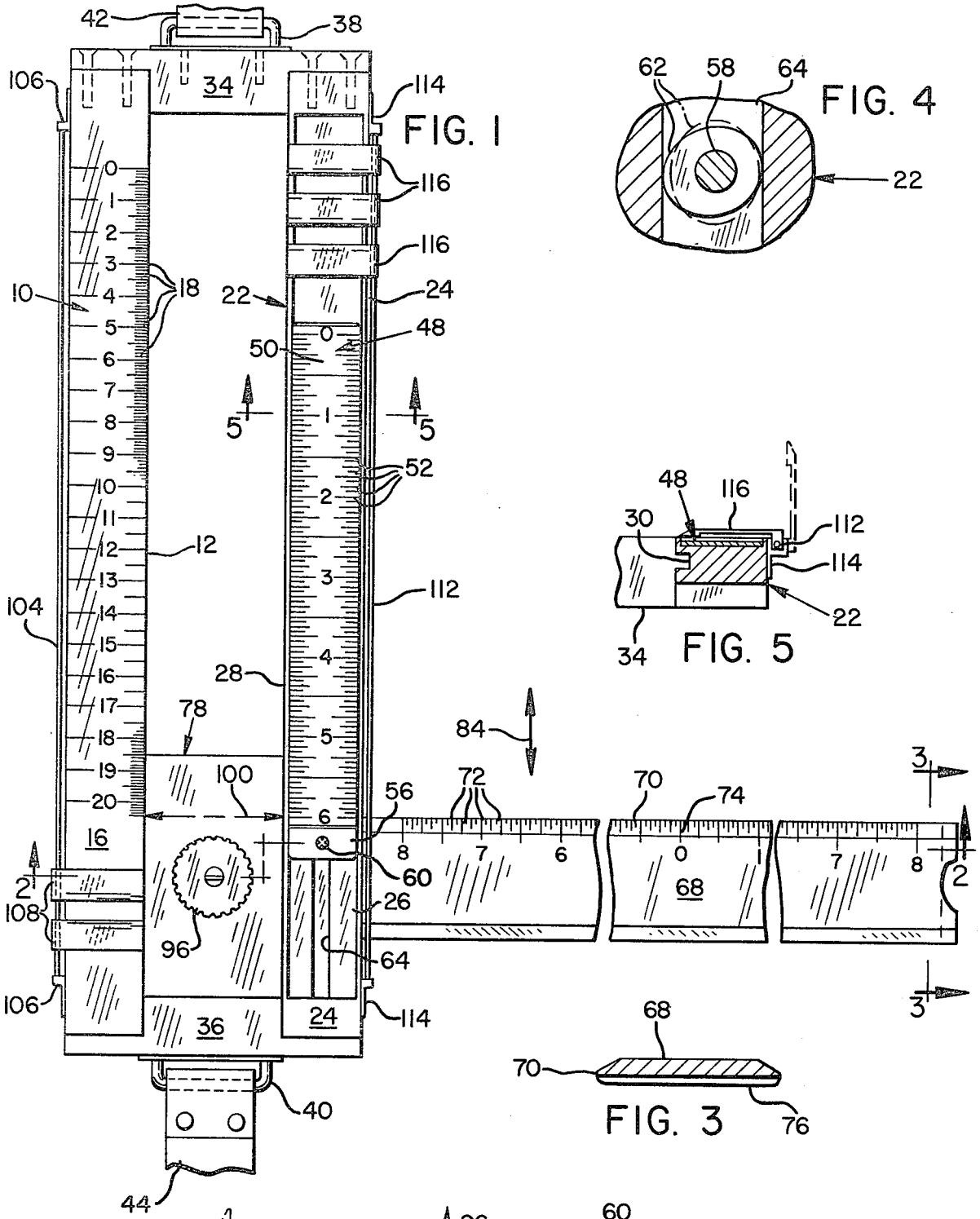
FIG. 1
FIG. 4
FIG. 5
FIG. 3
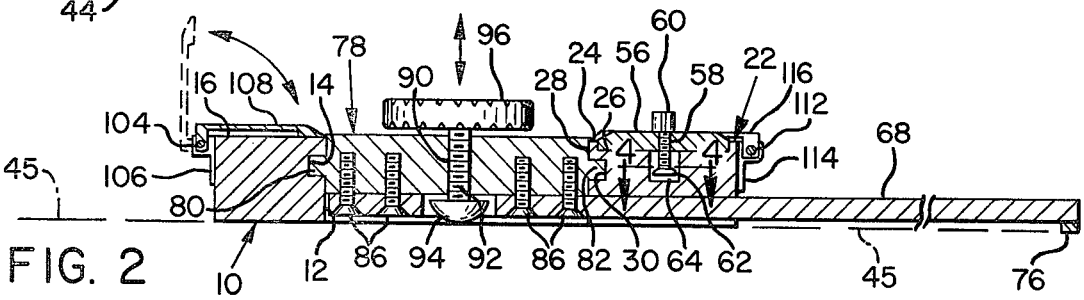
FIG. 2

GUIDELINE AND LAYOUT RULER FOR CALLIGRAPHERS

BACKGROUND OF THE INVENTION

The present invention relates generally to drafting instruments and particularly to rulers for use by calligraphers for laying out borders, margins, centerlines, guidelines and the like.

A variety of drafting and other special purpose rulers have been used over a number of years, but none of these instruments is specifically suited to the work of a calligrapher, whose craft has a variety of special requirements. Typically, a calligrapher will use several separate instruments, such as a centerline ruler, a T square, standard inch and metric rulers and drafting triangles, to lay out his work. Such use of multiple instruments is inconvenient, time consuming and frequently leads to unnecessary inaccuracies in the work.

Some more sophisticated instruments have included one or more fixed scales of numbered indicia that commence at one end of a T square-type ruler. While such devices may be suitable for many purposes, they do not substantially facilitate centering of work on a page nor can they be used efficiently to draw lettering guidelines on a page without the simultaneous use of multiple instruments. This is because the scales which they contain are preestablished at fixed locations and because the scales include indicia set at fixed intervals which may or may not be convenient for calligraphic work. Since the scales are immovable and contain fixed uniform indicia, frequently the indicia will not happen to register with the guidelines the calligrapher intends to draw.

SUMMARY OF THE INVENTION

The present invention comprises a ruler which eliminates the above problem of the prior art. It includes a fixed vertical scale and a removable vertical scale. The removable vertical scale is slidably movable along a path parallel to the fixed vertical scale and may be secured at any point along the path. It easily may be interchanged with alternate removable scales having graduation indicia spaced to indicate lettering guidelines of any desired width.

Movable cursors are provided on both the vertical scales to mark desired indicia thereon. A horizontal straightedge member is mounted at a fixed angle, preferably 90 degrees, to the vertical scales for sliding movement in a direction parallel to the longitudinal axes of the vertical scales. It is provided with a set of graduation indicia providing a centerline rule, i.e. a rule on which graduations are numbered progressively in opposite directions from a center indicia designated zero at about the midpoint of the straightedge member.

Using this ruler along, margins, borders, centerlines and an appropriate set of horizontal lettering guidelines easily can be drawn at any location on a sheet of paper mounted alongside the ruler. Words and phrases to be lettered are rapidly centered on the page using the scale on the horizontal straightedge.

A primary object of the invention is to provide a guideline and layout ruler for calligraphers which combines in a single instrument all of the functions heretofore requiring several different instruments to perform.

Other general objects are to provide a ruler as aforesaid which is fast and simple to operate.

A more specific object is to provide a ruler as aforesaid which combines the different scales, pointers for aligning the scales relative to one another and cursors to mark locations of the pointers in a manner to enable laying out all the necessary guidelines, margins and borders of a calligraphic work.

It is a specific object of the present invention to provide a calligrapher's ruler which includes a longitudinally slidable scale that contains appropriate indicia for establishing horizontal guidelines for calligraphic lettering.

Also, a specific object is to provide a ruler having a replacable guideline scale for customizing the ruler for use in laying out guidelines for specific styles and sizes of lettering.

Another specific object is to provide such a ruler with a horizontal scale having indicia numbered both directions from a central point for centering the text to be lettered.

A further specific object is to provide a plurality of cursors positionable on one or more vertical scales to indicate various locations of a horizontal straight edge member.

Other objects and advantages of the present invention will become apparent from reading the following detailed specification with reference to the accompanying drawing.

BRIEF DESCRIPTION OF THE DRAWING

In the drawing:

FIG. 1 is a plan view of a preferred embodiment of the present invention;

FIG. 2 is an enlarged sectional view taken along line 2—2 of FIG. 1;

FIG. 3 is an enlarged sectional view taken along line 3—3 of FIG. 1;

FIG. 4 is an enlarged partial sectional view taken along line 4—4 of FIG. 2; and FIG. 5 is a partial sectional view taken along lines 5—5 of FIG. 1.

DESCRIPTION OF A PREFERRED EMBODIMENT

As can be seen from the drawing, a preferred embodiment of the calligrapher's ruler according to the present invention includes a rigid longitudinal scale assembly which has two longitudinal members which both bear scale graduation indicia. An elongated first longitudinal member 10 has an inner sidewall 12 that contains a longitudinal groove 14 as shown in FIG. 2. This longitudinal member 10 also includes a flat, upwardly facing surface 16 which bears a first set of graduation indicia 18 spaced along the surface 16 at fixed locations to define a first vertical scale which is graduated in millimeters.

An elongated second longitudinal member 22 is of similar length as the first elongated member 10 and is positioned parallel to and laterally spaced from the first elongated member so that the ends of the two longitudinal members are in substantial alignment. The second longitudinal member 22 has an upwardly facing surface 24 which defines an upwardly opening channel 26. The second longitudinal member 22 also includes an inner sidewall 28 which contains a longitudinal groove 30 facing the sidewall 12 of the first elongated member 10.

Upper and lower cross frame members 34, 36 are positioned to extend between the longitudinal members 10, 22 at the ends thereof to maintain the longitudinal members in a fixed spaced relationship. Loops 38, 40 are attached to the outermost ends of the cross frame members 34, 36 to retain straps 42, 44 which may be used to secure the ruler against a flat supporting surface such as the upper surface of a drafting table indicated as a dashed line 45 in FIG. 2.

The scale graduation indicia of the second longitudinal member 22 are located on an elongated scale or ruler insert 48 which is slidably received in the channel 26. This ruler insert has a flat, upwardly facing surface 50 which bears a second set of graduation indicia 52 that are spaced to define a second vertical scale which may be different than the scale defined by the indicia 18. Like the first vertical scale, the second vertical scale is numbered downwardly from an indicia labelled zero near the upper end of the ruler insert 48. In the illustrated embodiment, the indicia 52 define an inch scale, but could define any other suitable or desired scale.

To customize the ruler for use in laying out a selected style and size of calligraphic lettering, the ruler insert 48 may be removed from the channel 26 and replaced with another ruler insert bearing a different scale. Such substitute ruler inserts could bear indicia at the exact spacing of the horizontal guidelines used by calligraphers for defining the height of various portions of hand-drawn letters of the selected style.

The ruler insert 48 does not mount at a fixed position on the second longitudinal member 22, but instead is free to slide longitudinally in the channel 26. An abutment or stop 56 is provided in the channel 26 at one end of the ruler insert 48 so that the ruler insert may be temporarily located at a fixed position. A locking device detachably secures the abutment to the second elongated member 22. In the illustrated embodiment, the locking device comprises a threaded rod 58 which extends through a threaded opening in the abutment 56. Opposite ends of the rod 58 respectively terminate in a head 60 which can be rotated by the calligrapher and an elliptical foot 62 which extends into a slot 64 in the base of the channel 26. The slot 64 extends parallel to the channel 26 so that the foot portion 62 can move through the slot 64 as the abutment 56 slides longitudinally along the channel. When the abutment is located at a desired position, the head portion 60 is rotated until outwardly projecting portions of the foot 62 contact the sidewalls of the slot 64 wedgingly to lock the abutment 56 in place.

An elongated lateral straightedge member 68 extends beneath and laterally from the second longitudinal member 22 of the longitudinal scale assembly. The straightedge member comprises a centerline ruler with a straight scribing edge 70 and a third set of graduation indicia 72 spaced along the edge 70 and numbered in each direction from a central indicia 74 designated zero at about the midpoint of the scribing edge 70. A skid 76 located beneath the straightedge member 68 near its free end has its lower surface in alignment with the lower surface of the longitudinal member 10 and maintains the straightedge member 68 a small distance above supporting surface 45 on which the ruler rests. The skid 76 should be of sufficient height so that a paper or card to be lettered by the calligrapher can be received between straightedge member 68 and the supporting surface.

An attachment device is provided to join the longitudinal members 10 and 22 and the straightedge member together. It comprises a central or slide member 78 which connects to one end of the straightedge member 68 and is slidably retained in a central guideway defined between the longitudinal members 10, 22. Opposed tongues 80, 82 (FIG. 2) extend outwardly from the central member 78 and are received by the grooves 14, 30 so that the central member 78 can move only in a direction parallel to the longitudinal axes of the elongated longitudinal members 10, 22. The straightedge member 68 is thus also movable in a direction parallel to the longitudinal axes of the longitudinal members 10, 22, which direction is indicated by an arrow 84 in FIG. 1. Screws 86 permanently mount the straightedge member 68 to the central member 78 at a fixed angle such that the scribing edge 70 is maintained perpendicular to the elongated longitudinal members 10, 22.

A locking device is provided to lock the central member 78 and connected straightedge member 68 in a selected position along the longitudinal member 10, 22. As illustrated in FIG. 2, the locking device may comprise a threaded shaft 92 received by an internally threaded opening 90 through the central member 78. A resilient foot 94 is located at the end of the shaft which is nearest the supporting surface 45 of the table on which the ruler is mounted. A knurled ciontrol knob 96 is provided at the upper end of the shaft for manually rotating the shaft to move the foot vertically between positions in and out of contact with the supporting surface 45.

When the rule is securely attached to a supporting surface 45 by the straps 42, 44 and the foot 94 is moved downwardly against the surface, the tongues 80, 82 are lifted upwardly and wedged against the upper sidewalls of the grooves 14, 30, thereby securing the central member 78 in a fixed position relative to the elongated members 10, 22. When it is subsequently desired to move the straightedge member 68 to a new position relative to the longitudinal members, the control knob is rotated in the opposite direction to raise the foot 94 so that the central member 78 can slide easily between the longitudinal members 10, 22.

Inscribed on an upwardly facing surface of the central member 78 is a horizontal indicator line 100 in the form of a double-ended pointer which preferably is colinear with the scribing edge 70 of the straightedge member 68. One end of the pointer is directed toward the scale of indicia 18 and the other end is directed toward the scale of indicia 52. To locate the scribing edge 70 at a premeasured position relative to the vertical scales, the line 100 is aligned with one of the selected graduation indicia 18, 52.

Displaced laterally from and extending parallel to the first longitudinal member 10 is a first rod 104 which is attached at each end to the first longitudinal member 10 by rod hangers 106. Hairline indicators or cursors 108 are slidably journaled on the first rod 104 and shaped to be positioned over the first set of graduation indicia 18 to indicate a selected location along the scale defined by the indicia 18. Each indicator 108 will preferably have three hairlines spaced at half millimeter intervals so that the indicators will comprise means for interpolating between the millimeter indicia 18.

A second rod 112 is displaced laterally from and extends parallel to the second longitudinal member 22. The second rod 112 is attached at each end to the second longitudinal member 22 by rod hangers 114. Hairline indicators 116 are journaled on the second rod 112 and shaped to be positioned over the second set of graduation indicia 52 to indicate selected locations along the scale defined by the indicia 52.

As can be seen in FIGS. 2 and 5, the indicators 108, 116 can be rotated about the shaft and thus entirely removed from contact with the upwardly facing surfaces 16, 24 of the longitudinal members. This arrangement is especially helpful should it be desired to substitute a new ruler insert for the ruler insert 48. To facilitate substitution, the indicators 116 can be rotated to the position shown by broken lines in FIG. 5 so that the ruler insert 48 can be removed. An alternate ruler insert is then placed in the channel 26 and the hairline indicators 116 returned to the position shown by solid lines in FIG. 5. In this way, it is possible to replace the ruler 48 without losing track of the positions marked by the hairline indicators 116.

OPERATION

Rulers according to the present invention may be used conveniently in a number of ways which will be readily apparent to a skilled calligrapher. In general, the ruler is first secured to a support surface 45, such as the upper surface of a drafting board, using the straps 42, 44 or other appropriate means. The central member 78 is then moved as far as possible toward the lower cross frame member 36 until it is in the position shown in FIG. 1. Next the control knob 96 is rotated until the central member 78 is locked in a fixed position relative to the longitudinal member 10, 22.

A sheet of paper to be lettered is secured to the supporting surface 45 by tape or other appropriate means. If the sheet is rectangular, it will preferably be aligned so that its lower edge lies along the scribing edge 70 of the straightedge member 68. When the paper is secured in this manner, the upper and lower edges of the paper are substantially parallel to the scribing edge 70. The paper will preferably be centered in respect to the central indicia 74 of the straight-edge member 68.

If border or cutting lines are to be drawn on the paper, their location may be established using indicia 52, 72 on the ruler insert 48 and straightedge member 68. The zero indicia on the ruler insert 48 is aligned with the top edge of the paper and maintained in place by moving the abutment 56 upwardly until it just abuts the bottom of the ruler 48. Once the abutment 56 is in position, the head 60 of the rod 58 is rotated to lock the abutment in place thereby establishing the ruler insert 48 at an appropriate position along the second elongated member 22.

The spacing of horizontal margin and border lines may then be measured using the indicia 52. The straightedge member is moved as needed so that the line 100 will be indexed with appropriate indicia for drawing margins and border lines using the scribing edge 70. Horizontal boundaries not to be defined by lines on the paper may be indicated by placing the hairline indicators 116 at appropriate intervals along the scale defined by indicia 52. By reference to these hairline indicators 116, the calligrapher will know not to draw guidelines on the paper when the line 100 is located between the hairlines of the indicator.

In most instances, the metric graduations of the indicia 18 will be sufficient to locate and space the horizontal lines which will serve as the actual lettering guidelines. The uppermost lettering guideline on a page may be established by aligning the line 100 with an appropriate indicia 18 on the first elongated member 10 and securing the central member 78 at that position using the locking means. The scribing edge 70 of the straightedge member 68 can then be used for drawing the uppermost guideline on the paper. After the first line is drawn, the locking means is released and the central member 78 moved downwardly until the line 100 aligns with the next desired indicia on the longitudinal member 10. The next guideline is then drawn using the scribing edge 70 and the procedure repeated down the length of the page. If desired, the central member 78 can be locked in position using the locking means to stabilize the straightedge member 68 before each guideline is drawn.

The hairline indicators 108 may be used during this process to mark the position of the uppermost guideline on the scale of indicia 18 to serve as a reference point for locating the positions of lower guidelines. These hairline indicators may also be used to reference the bottom of a series of multiple horizontal guidelines so that the space between each series may be measured from the indicia indicated by the hairline. And, as previously mentioned, the hairlines 108 may be used to provide a horizontal line midway between two millimeter indicia so that the guideline 100 can be located at a half millimeter position along the vertical scale of indicia 18.

The horizontal guidelines for calligraphic lettering are organized in series of two to six guidelines for each horizontal line of text. These multiple lines, which indicate the heights of letters and portions of letters, frequently are not spaced at equal intervals; nor does the spacing between lines of text necessarily relate to the height of letters used. Hairline indicators 108, 116 are thus helpful to mark the location of top and bottom lines of series or to serve as reference points indicating the uppermost or lowermost line of an immediate preceding series for the purpose of establishing the spacing between adjacent lines of text.

If for some reason the horizontal lettering guidelines are to be spaced unevenly and cannot be conveniently located using either the scale of indicia 18 or of indicia 52, a substitute ruler insert with more convenient graduation indicia can be used in place of the ruler insert 48. The substitute ruler insert is selected to provide indicia which most suitably indicate the spacing between horizontal guidelines to be drawn on the paper. Substitute rulers may thus be marked with unevenly spaced indicia that specifically indicate the locations of the guidelines, or may have indicia spaced at a regular interval, such as one tenth of an inch.

It will be obvious to those having ordinary skill in the art that many changes may be made in the above-described preferred embodiment without departing from the spirit of the invention. For example, a variety of different apparatuses could be used for securing the ruler to a supporting surface or for clamping the central member and abutment to the longitudinal members. It would also be logical to include additional hairline indicators on the straightedge member. Therefore, the scope of the invention should only be defined by the following claims.

I claim:

1. A layout ruler comprising:

an elongated first longitudinal member having an upwardly facing surface bearing a first set of graduation indicia spaced therealong;

elongated ruler insert means in parallel laterally spaced relation to said first longitudinal member, said ruler means having an upwardly facing surface bearing a second set of graduation indicia space therealong;

an elongated second longitudinal member defining a channel to slidably receive said ruler insert means, both said longitudinal members have inner sidewalls which face each other to define a central guideway therebetween, each of said walls defining a longitudinal groove;

a cross frame member which extends between said longitudinal members and retains said longitudinal members in spaced parallel relationship;

an elongated lateral straightedge member having a straight scribing edge;

attachment means slidably connecting one end of said straightedge member to said first longitudinal member for movement of said straightedge member in a direction parallel to the longitudinal axis of said first longitudinal member and for maintaining said straightedge at a fixed angle relative to said axis, said attachment means including a central member slidably retained in said guideway by opposed tongues which extend outwardly from said central member and are received by said grooves; and locking means for detachably retaining said central member in a fixed position relative to said longitudinal members, said locking means including means for securing said ruler against a flat supporting surface, a threaded shaft received by a vertical threaded opening through said central member, a foot at the end of said shaft nearest said supporting surface, and a control knob at the other end of said shaft for rotating said shaft to move said foot vertically between positions in and out of contact with said supporting surface.

2. A layout ruler comprising:

an elongated first longitudinal member having an upwardly facing surface bearing a first set of graduation indicia spaced therealong;

elongated ruler insert means in parallel laterally spaced relation to said first longitudinal member, said ruler means having an upwardly facing surface bearing a second set of graduation indicia space therealong;

support means attached to said first longitudinal member to slidably retain said ruler insert means for movement in a direction parallel to the longitudinal axis of said first longitudinal member;

an elongated lateral straightedge member having a straight scribing edge;

attachment means slidably connecting one end of said straightedge member to said first longitudinal member for movement of said straightedge member in a direction parallel to the longitudinal axis of said first longitudinal member and for maintaining said straightedge at a fixed angle relative to said axis;

a rod displaced laterally from and extending parallel to one said longitudinal member, said rod being attached at each end to said one said longitudinal member; and at least one hairline indicator slidably journaled on said rod and shaped for positioning over the set of graduation indicia of said one said longitudinal member to indicate a selected location thereon, said hairline indicator including three horizontal hairlines spaced at intervals equal to one half the interval of graduation indicia of said one said longitudinal member.

* * * * *